US006554330B2

(12) United States Patent
Wen-Bin et al.

(10) Patent No.: US 6,554,330 B2
(45) Date of Patent: Apr. 29, 2003

(54) REINFORCING STRUCTURE OF A LATCH OF AN AUXILIARY LOCK

(75) Inventors: Wu Wen-Bin, Kaohsiung Hsien (TW); Huang Chao-Ming, Kaohsiung Hsien (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 0 days.

(21) Appl. No.: 09/933,069

(22) Filed: Aug. 21, 2001

(65) Prior Publication Data

US 2003/0038487 A1 Feb. 27, 2003

(51) Int. Cl.[7] ..... E05C 1/16
(52) U.S. Cl. ..... 292/346; 292/337
(58) Field of Search ..... 292/346, 337, 292/DIG. 53, DIG. 60

(56) References Cited

U.S. PATENT DOCUMENTS 4,687,239 A * 8/1987 Lin ..... 292/1.5
4,890,871 A 1/1990 Lin ..... 292/337
5,074,605 A 12/1991 Fann ..... 292/337
5,456,503 A * 10/1995 Russell, IV ..... 292/1.5
5,769,472 A * 6/1998 Small ..... 292/1.5
6,186,562 B1 * 2/2001 Huang ..... 292/169

FOREIGN PATENT DOCUMENTS

TW 79204628 8/1990

* cited by examiner

*Primary Examiner*—Anthony Knight
*Assistant Examiner*—Mark Williams
(74) *Attorney, Agent, or Firm*—Bacon & Thomas, PLLC

(57) ABSTRACT

A reinforcing structure of a latch of an auxiliary lock includes a lock tongue set having a lock tongue provided with at least one flat surface. A reinforcing plate is fixed in the gap between the flat surface of the lock tongue and the housing, so that the housing may withstand and support a larger external impact force.

3 Claims, 2 Drawing Sheets

REINFORCING STRUCTURE OF A LATCH OF AN AUXILIARY LOCK

BACKGROUND OF THE INVENTION

1. Field of the Invention

The present invention relates to a reinforcing structure of a latch of an auxiliary lock, wherein the housing of the latch of the auxiliary lock has a larger strength, and may withstand and support a larger external impact force.

2. Description of the Related Art

The closest prior art of which the applicant is aware is disclosed in the applicant Taiwanese Patent Publication No. 139733, entitled mproved Structure of a Latch of a Auxiliary Lock. In such an improved structure, the lock tongue of the housing is directly combined with one end of a drawing plate. The other end of the drawing plate is provided with two drive teeth and a positioning tooth, so that the arm of the rotatable drive seat may be inserted between the two drive teeth, to press the drawing plate and the lock tongue to act.

The housing of the latch of the auxiliary lock may be punched by a metallic plate, or made of a zinc alloy. If the housing of the latch of the auxiliary lock is made of a zinc alloy, the strength of the zinc alloy is not large enough, so that the zinc alloy cannot efficiently withstand the external impact force. Thus, the safety of the latch is not sufficient.

SUMMARY OF THE INVENTION

The primary objective of the present invention is to provide a reinforcing structure of a latch of an auxiliary lock, wherein the housing of the latch of the auxiliary lock has a larger strength, and may withstand and support a larger external impact force, and has a better safety.

In accordance with the present invention, there is provided a reinforcing structure of a latch of an auxiliary lock including a lock tongue set having a lock tongue provided with at least one flat surface. A reinforcing plate is fixed in the gap between the flat surface of the lock tongue and the housing, so that the housing may withstand and support a larger external impact force.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
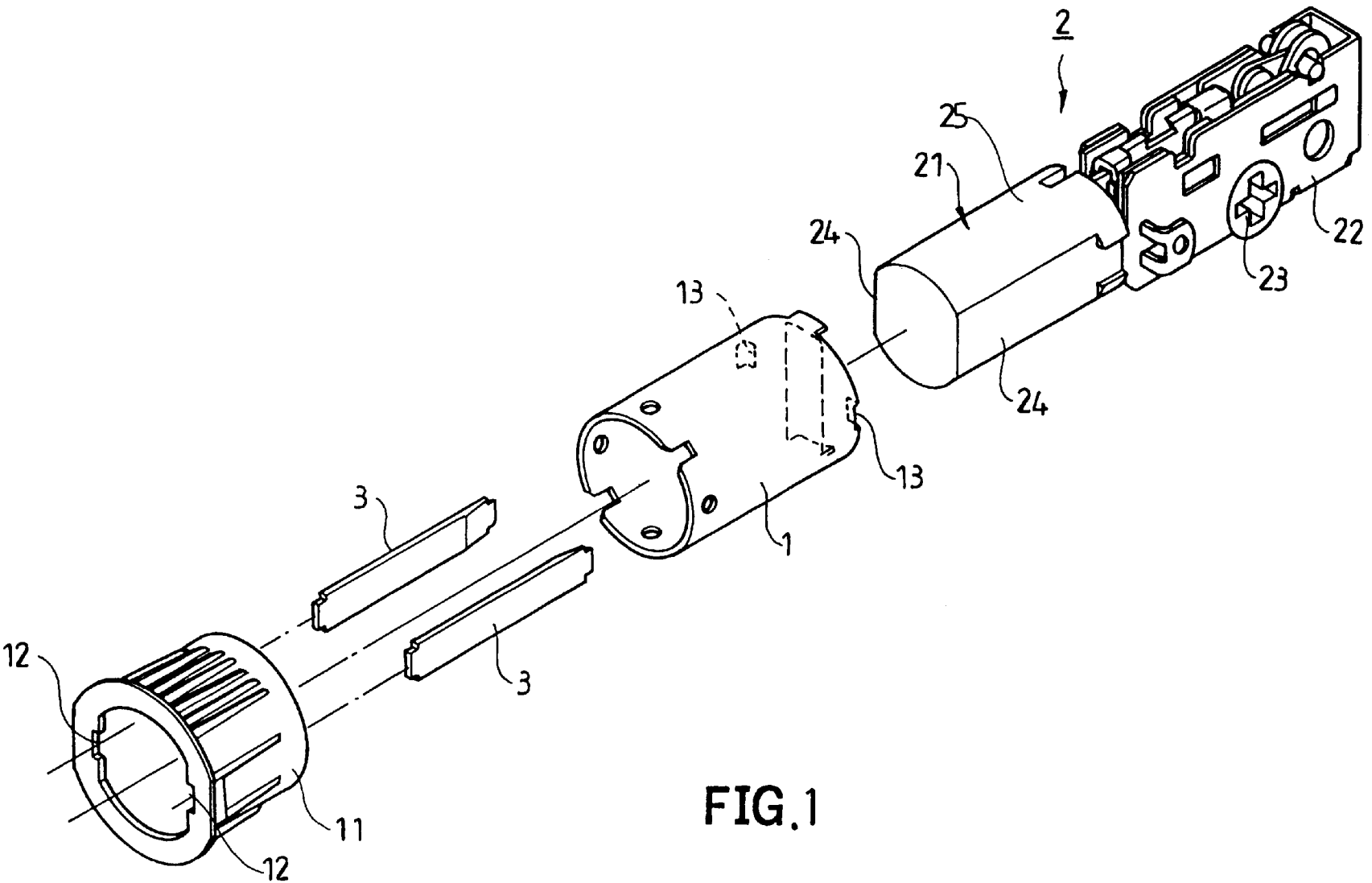
FIG. 1 is an exploded perspective view of a reinforcing structure of a latch of an auxiliary lock in accordance with the preferred embodiment of the present invention.

Referring to the drawings and initially to FIG. 1, a reinforcing structure of a latch of an auxiliary lock in accordance with the preferred embodiment of the present invention comprises a housing 1, a lock tongue set 2, and at least one (preferably two) reinforcing plate 3.

The housing 1 may be a conventional structure, and may be formed as a circular cylinder. One end of the housing 1 may be combined with the circular face plate 11. The housing 1 itself may also be combined with a rectangular face plate (not shown), so that the housing 1 may be fixed on the door plate at a proper position thereof, and may allow the lock tongue to extend outward from or retract into the face plate 11. The other end of the housing 1 may receive the lock tongue 21 therein, and has an end edge which is combined with the assembly plate 22 of the lock tongue set 2.

The lock tongue set 2 may be a conventional structure, and includes a lock tongue 21 and an assembly plate 22. The assembly plate 22 slightly located at the rear end is combined with the housing 1, and the lock tongue 21 may be placed into the housing 1. The drive member 23 may draw the lock tongue 21 to act, such that the other end of the lock tongue 21 may extend outwardly from or retract into the face plate 11. The lock tongue 21 has at least one flat surface 24. Preferably, the lock tongue 21 has two symmetrically arranged concave portions 25.

The reinforcing plate 3 is made of a hard and rigid material such as a metal, and may be punched by a metallic plate to form the reinforcing plate 3. The reinforcing plate 3 may be fixed in the housing 1 by various fixing methods, and is located in the gap between the flat surface 24 of the lock tongue 21 and the housing 1. As shown in the figure, the face plate 11 is provided with two openings 12, and the housing 1 is provided with two positioning holes 13, so that the two ends of the reinforcing plate 3 may be fixed in the opening 12 and the positioning hole 13 securely and tightly.

Figure 2:
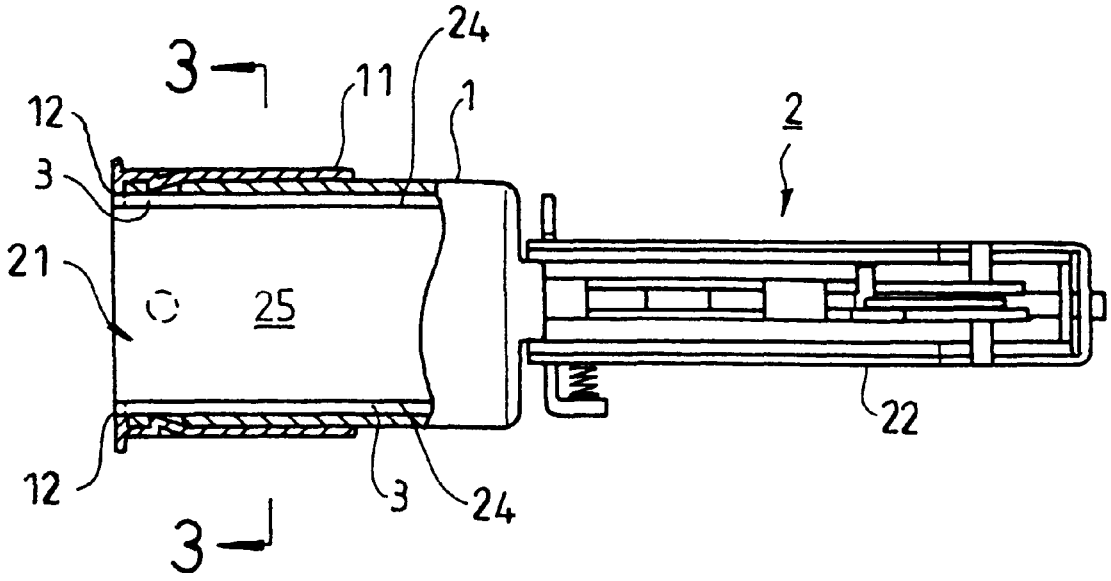
FIG. 2 is a top plan cross-sectional assembly cross-sectional view of the reinforcing structure of a latch of an auxiliary lock as shown in FIG. 1.
Figure 3:
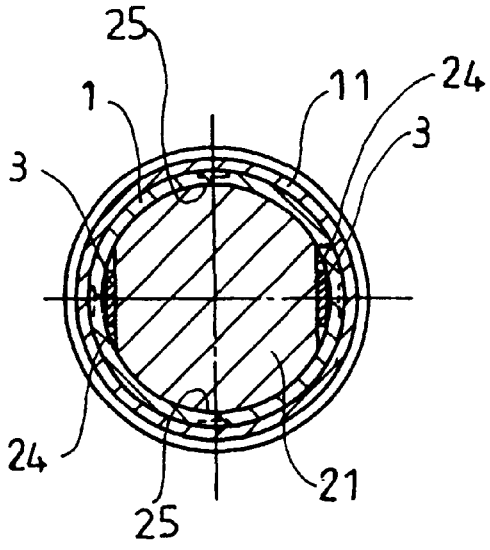
FIG. 3 is a cross-sectional view of the reinforcing structure of a latch of an auxiliary lock taken along line 3—3 as shown in FIG. 2.

As shown in FIGS. 2 and 3, the assembly of the reinforcing structure of a latch of an auxiliary lock in accordance with the preferred embodiment of the present invention is shown. The reinforcing plate 3 is fixed in the housing As shown in FIGS. 2 and 3, the assembly of the reinforcing structure of a latch of an auxiliary lock in accordance with the preferred embodiment of the present invention is shown. The reinforcing plate 3 is fixed in the housing 1, and is located in the gap between the flat surfaces 24 of the lock tongue 21 and the housing 1. Thus, the reinforcing plate 3 and the lock tongue 21 will closely occupy the inner space of the housing 1, so that when the housing 1 is subjected to an external impact or hitting force, the housing 1 will not have sufficient space to allow deformation and retraction, so that the housing 1 may withstand and support a larger external impact force, thereby providing for better strength and greater safety.

Accordingly, in accordance with the reinforcing structure of a latch of an auxiliary lock of the present invention, the housing itself has a greater strength, such that the housing is not deformed easily, and may withstand and support a larger external impact force.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A reinforcing structure of a latch of an auxiliary lock, comprising:

a housing, forming a hollow cylinder, having one end combined with a face plate;

a lock tongue set, including a lock tongue and an assembly plate, said assembly plate combined with said housing, said lock tongue received in said housing, a drive member driving said lock tongue to extend outward from or retract into said face plate, said lock tongue having at least one flat surface; and a first reinforcing plate comprising a hard material, said first reinforcing plate fixed to said housing and located between said flat surface of said lock tongue and an inner wall of said housing, such that said first reinforcing plate reinforces structural integrity of said housing.

2. The reinforcing structure of a latch of an auxiliary lock as claimed in claim 1, wherein said face plate is provided with at least one opening, said housing is provided with at least one positioning hole, and two ends of said first reinforcing plate are fixed in said opening and said positioning hole in a close fit manner.

3. The reinforcing structure of a latch of an auxiliary lock as claimed in claim 1, wherein said lock tongue includes two symmetrically arranged flat surfaces, and said reinforcing structure further comprises a second reinforcing plate symmetrically arranged with said first reinforcing plate.

* * * * *